US010495368B2

(12) United States Patent
Takami et al.

(10) Patent No.: US 10,495,368 B2
(45) Date of Patent: Dec. 3, 2019

(54) REFRIGERATOR AND OPERATION METHOD OF THE SAME

(71) Applicant: PANASONIC CORPORATION, Osaka (JP)

(72) Inventors: Fuminori Takami, Osaka (JP); Hisakazu Sakai, Shiga (JP); Katsunori Horii, Shiga (JP); Yoshimasa Horio, Shiga (JP)

(73) Assignee: PANASONIC CORPORATION, Osaka (JP)

( * ) Notice: Subject to any disclaimer, the term of this patent is extended or adjusted under 35 U.S.C. 154(b) by 159 days.

(21) Appl. No.: 15/891,060

(22) Filed: Feb. 7, 2018

(65) Prior Publication Data

US 2018/0238603 A1 Aug. 23, 2018

(30) Foreign Application Priority Data

Feb. 21, 2017 (JP) ..... 2017-030030

(51) Int. Cl.
*F25D 21/04* (2006.01)
*F25D 17/06* (2006.01)
(Continued)

(52) U.S. Cl.
CPC ..... *F25D 21/04* (2013.01); *F25B 41/04* (2013.01); *F25B 41/067* (2013.01);
(Continued)

(58) Field of Classification Search
CPC .. F25D 21/04; F25D 21/08; F25D 2321/1413; F25D 2321/146; F25B 41/04;
(Continued)

(56) References Cited

U.S. PATENT DOCUMENTS 5,775,124 A * 7/1998 Park ..... F25D 17/045 62/408
2007/0214824 A1* 9/2007 Itsuki ..... F25B 6/04 62/279
2017/0350630 A1* 12/2017 Hirai ..... F25B 1/005

FOREIGN PATENT DOCUMENTS

JP 04-194564 A 7/1992
WO WO-2012157263 A1 * 11/2012 ..... F25D 21/04
WO WO-2017179500 A1 * 10/2017 ..... F25B 47/02

* cited by examiner

*Primary Examiner* — Marc E Norman
(74) *Attorney, Agent, or Firm* — McDermott Will & Emery LLP

(57) ABSTRACT

A refrigerator includes: a compressor; an evaporator; a main condenser; a dew-prevention pipe; a bypass provided in parallel with a first channel from the main condenser to the dew-prevention pipe, and connected with the evaporator; a switching section provided on a downstream side of the main condenser, in which the switching section opens and closes the first channel, and a second channel from the main condenser to the bypass; and a control section. When defrosting the evaporator, the control section operates in such a manner that a refrigerant staying in the evaporator, the dew-prevention pipe, and the bypass is collected in the main condenser by closing the first channel and the second channel during an operation of the compressor, and thereafter, a high-pressure refrigerant collected in the main condenser is supplied to the evaporator through the bypass by stopping the compressor and opening the second channel.

7 Claims, 5 Drawing Sheets

(51) Int. Cl.

| | |
|---|---|
| ***F25B 41/04*** | (2006.01) |
| ***F25B 41/06*** | (2006.01) |
| ***F25B 47/02*** | (2006.01) |
| *F25D 21/08* | (2006.01) |

(52) U.S. Cl.
CPC ..... *F25B 47/022* (2013.01); *F25D 17/067* (2013.01); *F25B 2341/0661* (2013.01); *F25B 2400/05* (2013.01); *F25B 2600/0251* (2013.01); *F25B 2600/2507* (2013.01); *F25B 2700/02* (2013.01); *F25D 21/08* (2013.01); *F25D 2321/146* (2013.01); *F25D 2321/1413* (2013.01); *F25D 2700/10* (2013.01)

(58) Field of Classification Search
CPC ..... F25B 41/067; F25B 2341/0661; F25B 2600/0521; F25B 2600/2507
See application file for complete search history.

REFRIGERATOR AND OPERATION METHOD OF THE SAME

CROSS REFERENCE TO RELATED APPLICATIONS

This application is entitled to and claims the benefit of Japanese Patent Application No. 2017-030030, filed on Feb. 21, 2017, the disclosure of which including the specification, drawings and abstract is incorporated herein by reference in its entirety.

TECHNICAL FIELD

The present invention relates to a refrigerator and an operation method of the same. More specifically, the present invention relates to a refrigerator and an operation method of the same which reduce the output of a defrosting electric heater.

BACKGROUND ART

Overview

Conventionally, a refrigerator is known in which the energy of heating an evaporator of a high-pressure refrigerant flowing in the evaporator by a pressure difference in a refrigeration cycle is used to reduce the output of the defrosting electric heater from a view point of energy saving (see, for example, PTL 1).

In such a refrigerator, while a high-pressure refrigerant stored in the condenser of the refrigeration cycle is maintained at a temperature near the outside air even after the compressor is stopped, the evaporator is in a low temperature state of −30° C. to −20° C. In view of this, the output of the defrosting electric heater is actively reduced for the purpose of energy saving by increasing the amount of the high-pressure refrigerant which flows into the evaporator by a pressure difference, by increasing the enthalpy of the inflow high-pressure refrigerant to increase the inflow heat value, or the like.

Configuration

A conventional refrigerator is described below with reference to FIGS. 6 to 8.

FIG. 6 is a longitudinal sectional view of a conventional refrigerator. FIG. 7 illustrates a refrigeration cycle configuration of a conventional refrigerator. FIG. 8 illustrates a defrosting operation of a conventional refrigerator.

As illustrated in FIG. 6, refrigerator 11 includes casing 12, door 13, leg 14 that supports casing 12, lower mechanic compartment 15 provided on the lower side of casing 12, refrigerating compartment 17 disposed on the upper side of casing 12, and freezing compartment 18 disposed on the lower side of casing 12.

In addition, as illustrated in FIG. 6 and FIG. 7, refrigerator 11 includes, as components of the refrigeration cycle, compressor 56 housed in lower mechanic compartment 15, evaporator 20 housed on the back side of freezing compartment 18, and main condenser 21 housed in lower mechanic compartment 15.

In addition, as illustrated in FIG. 6, refrigerator 11 includes partition wall 22 that partitions lower mechanic compartment 15, fan 23 attached on partition wall 22 and configured to air-cool main condenser 21, evaporating dish 57 installed on an upper side of compressor 56, and bottom plate 25 of lower mechanic compartment 15.

In addition, as illustrated in FIG. 6, refrigerator 11 includes a plurality of intake ports 26 provided in bottom plate 25, exhaust port 27 provided on the back side of lower mechanic compartment 15, and air-communication passage 28 that connects lower mechanic compartment 15 of exhaust port 27 and an upper part of casing 12. Here, lower mechanic compartment 15 is divided into two compartments by partition wall 22, and lower mechanic compartment 15 houses main condenser 21 on the air-upstream side of fan 23 and compressor 56 and evaporating dish 57 on the air-downstream side of fan 23.

In addition, as illustrated in FIG. 7, refrigerator 11 includes, as components of the refrigeration cycle, dew-prevention pipe 60, dryer 37, and throttle 42. Dew-prevention pipe 60 is located on the downstream side of main condenser 21, and thermally coupled with the exterior surface of casing 12 in the proximity of the opening of freezing compartment 18. Dryer 37 is located on the downstream side of dew-prevention pipe 60, and dries the circulating refrigerant. Throttle 42 couples dryer 37 and evaporator 20, and reduces the pressure of the circulating refrigerant. Further, refrigerator 11 includes two-way valve 46 and a defrosting heater (not illustrated). When defrosting evaporator 20, two-way valve 46 closes the outlet of dew-prevention pipe 60, and the defrosting heater heats evaporator 20.

In addition, as illustrated in FIG. 6, refrigerator 11 includes evaporator fan 50, freezing compartment damper 51, refrigerating compartment damper 52, duct 53, FCC temperature sensor 54, PCC temperature sensor 55, and DEF temperature sensor 58. Evaporator fan 50 supplies cold air generated in evaporator 20 to refrigerating compartment 17 and freezing compartment 18. Freezing compartment damper 51 blocks cold air to be supplied to freezing compartment 18. Refrigerating compartment damper 52 blocks cold air to be supplied to refrigerating compartment 17. Duct 53 supplies cold air to refrigerating compartment 17. FCC temperature sensor 54 detects the temperature of freezing compartment 18. PCC temperature sensor 55 detects the temperature of refrigerating compartment 17. DEF temperature sensor 58 detects the temperature of evaporator 20.

Operation

Next, an operation of a conventional refrigerator having the above-mentioned configuration is described.

In a cooling stop state where fan 23, compressor 56, and evaporator fan 50 are stopped (this operation state is hereinafter referred to as "OFF mode"), when the temperature detected by FCC temperature sensor 54 is raised to FCC_ON temperature of a predetermined value, or when a temperature detected by PCC temperature sensor 55 is raised to PCC_ON temperature of a predetermined value, the control section (not illustrated) of refrigerator 11 performs a PC cooling mode. Specifically, the control section closes freezing compartment damper 51 and opens refrigerating compartment damper 52, and, drives compressor 56, fan 23, and evaporator fan 50.

In the PC cooling mode, with an operation of fan 23, main condenser 21 side of lower mechanic compartment 15 partitioned by partition wall 22 is brought into a negative pressure state and the outside air is absorbed from a plurality of intake ports 26, whereas compressor 56 side and evaporating dish 57 side are brought into a positive pressure state and the air in lower mechanic compartment 15 is discharged to the outside from a plurality of exhaust ports 27.

On the other hand, the refrigerant discharged from compressor 56 is subjected to heat exchange with the outside air at main condenser 21 in such a manner as to be condensed while partially leaving gas, and thereafter the condensed refrigerant is supplied to dew-prevention pipe 60. The refrigerant passing through dew-prevention pipe 60 heats the opening of freezing compartment 18 while being condensed with the heat dissipation through casing 12. The liquid refrigerant condensed by dew-prevention pipe 60 passes through two-way valve 46 and is then subjected to moisture removal at dryer 37 and a pressure reduction at throttle 44, while being evaporated at evaporator 20 so as to exchange heat with the inner air of refrigerating compartment 17. With this configuration, the liquid refrigerant flows back to compressor 56 in the form of gas refrigerant while cooling refrigerating compartment 17.

In the PC cooling mode, when the temperature detected by FCC temperature sensor 54 is raised or lowered to FCC_OFF temperature of a predetermined value, and the temperature detected by PCC temperature sensor 55 is reduced to PCC_OFF temperature of a predetermined value, the control section of refrigerator 11 changes the mode from the PC cooling mode to an OFF mode.

In addition, in the PC cooling mode, when the temperature detected by FCC temperature sensor 54 has a temperature higher than FCC_OFF temperature of a predetermined value, and the temperature detected by PCC temperature sensor 55 is reduced to PCC_OFF temperature of a predetermined value, the control section of refrigerator 11 opens freezing compartment damper 51 and closes refrigerating compartment damper 52, and, drives compressor 56, fan 23, and evaporator fan 50.

Thereafter, the control section of refrigerator 11 operates the refrigeration cycle in the same manner as in the PC cooling mode to thereby perform heat exchange between evaporator 20 and the inner air of freezing compartment 18 to cool freezing compartment 18. In the following description, this operation is referred to as "FC cooling mode."

In the FC cooling mode, when the temperature detected by FCC temperature sensor 54 is reduced to FCC_OFF temperature of a predetermined value, and the temperature detected by PCC temperature sensor 55 is equal to or higher than PCC_ON temperature of a predetermined value, the control section of refrigerator 11 changes the mode from the FC cooling mode to the PC cooling mode.

In addition, in the FC cooling mode, when the temperature detected by FCC temperature sensor 54 is reduced to FCC_OFF temperature of a predetermined value, and the temperature detected by PCC temperature sensor 55 is lower than PCC_ON temperature of a predetermined value, the control section of refrigerator 11 changes the mode from the FC cooling mode to the OFF mode.

Control

Here, a defrosting operation of conventional refrigerator 11 is described with reference to FIG. 8.

When the integrated operation time of compressor 56 has reached a predetermined time, the mode is changed to a defrosting mode of heating and thawing the frost of evaporator 20. In section "p" in the defrosting mode, first, the control section of refrigerator 11 cools freezing compartment 18 for a predetermined time in the same manner as in the FC cooling mode to suppress the temperature rise of freezing compartment 18.

Next, in section "q," the control section of refrigerator 11 closes two-way valve 46 while operating compressor 56 to collect, in main condenser 21 and dew-prevention pipe 60, the refrigerant staying in dryer 37 and evaporator 20.

Then, in section "r," the control section of refrigerator 11 stops compressor 56 and causes backflow, to evaporator 20, of the high-pressure refrigerant collected in main condenser 21 and dew-prevention pipe 60 through a sealing part such as a valve (not illustrated) that partitions compressor 56 into the high pressure side and the low pressure side. Evaporator 20 is heated by the high-pressure refrigerant further heated by the waste heat of compressor 56.

Thereafter, in section "s," the control section of refrigerator 11 energizes defrosting heater 62 attached on evaporator 20 and terminates the defrosting.

Then, in section "t," the control section of refrigerator 11 opens two-way valve 46 to equalize the pressure in the refrigeration cycle, and restarts the normal operation from section "u."

As described above, in refrigerator 11, the evaporator is heated by utilizing the waste heat of the compressor and the high-pressure refrigerant of the refrigeration cycle, whereby the electric energy of the defrosting heater can be reduced, and energy saving of the refrigerator can be achieved.

CITATION LIST

Patent Literature

PTL 1
Japanese Patent Application Laid-Open No. 4-194564

SUMMARY OF INVENTION

Technical Problem

In the above-described configuration of the conventional refrigerator, however, when the high-pressure refrigerant collected in the main condenser and the dew-prevention pipe is used to defrost the evaporator, the temperature of the dew-prevention pipe thermally coupled with a portion in the proximity of the opening of the freezing compartment is reduced, and the high-pressure refrigerant in the main condenser which is maintained at a temperature approximately equal to the outside air is condensed in the dew-prevention pipe.

As a result, the high pressure is lowered and the amount of the refrigerant which flows into evaporator is reduced, and consequently, the electric energy of the defrosting heater cannot be sufficiently reduced.

Accordingly, it is desired to stably reduce the electric energy of the defrosting heater by maintaining the high pressure when the collected high-pressure refrigerant is used to defrost the evaporator.

In addition, in the above-described configuration of the conventional refrigerator, the backflow of the high-pressure refrigerant to the evaporator is caused after the compressor is stopped so as to heat the evaporator with the high-pressure refrigerant heated by the waste heat of the compressor, and the back flow of a leakage of a sealing part such as a valve that partitions the compressor into the high pressure side and the low pressure side is assumed. Therefore, the adjustment of the flow rate is difficult, and the amount of the refrigerant which flows into the evaporator is reduced, resulting in insufficient reduction in electric energy of the defrosting heater.

Accordingly, it is desired to stably reduce the electric energy of the defrosting heater by maintaining the channel resistance at the time of inflow of the high-pressure refrigerant into the evaporator when the collected high-pressure refrigerant is used to defrost the evaporator.

An object of the present invention is to stably reduce the electric energy of the defrosting heater, and to achieve the energy saving of the refrigerator.

Solution to Problem

A refrigerator according to embodiments of the present invention includes: a compressor; an evaporator; a main condenser; a dew-prevention pipe; a bypass provided in parallel with a first channel and connected with the evaporator, the first channel being a channel from the main condenser to the dew-prevention pipe; a switching section provided on a downstream side of the main condenser, wherein the switching section opens and closes the first channel and a second channel, the second channel being a channel from the main condenser to the bypass; and a control section, wherein, when defrosting the evaporator, the control section operates in such a manner that a refrigerant staying in the evaporator, the dew-prevention pipe, and the bypass is collected in the main condenser by closing the first channel and the second channel during an operation of the compressor, and thereafter, a high-pressure refrigerant collected in the main condenser is supplied to the evaporator through the bypass by stopping the compressor and opening the second channel.

An operation method according to embodiments of the present invention is a method of a refrigerator, the refrigerator including a compressor, an evaporator, a main condenser, and a dew-prevention pipe, wherein the refrigerator is provided with a bypass disposed in parallel with a first channel and connected with the evaporator, the first channel being a channel from the main condenser to the dew-prevention pipe, the method including: when defrosting the evaporator, collecting, in the main condenser, a refrigerant staying in the evaporator, the dew-prevention pipe, and the bypass by closing the first channel and a second channel during an operation of the compressor, the second channel being a channel from the main condenser to the bypass; and thereafter, supplying a high-pressure refrigerant collected in the main condenser to the evaporator through the bypass by stopping the compressor and opening the second channel.

Advantageous Effects of Invention

According to the present invention, the electric energy of the defrosting heater can be stably reduced, and energy saving of the refrigerator can be achieved.

DESCRIPTION OF EMBODIMENTS

Figure 1:
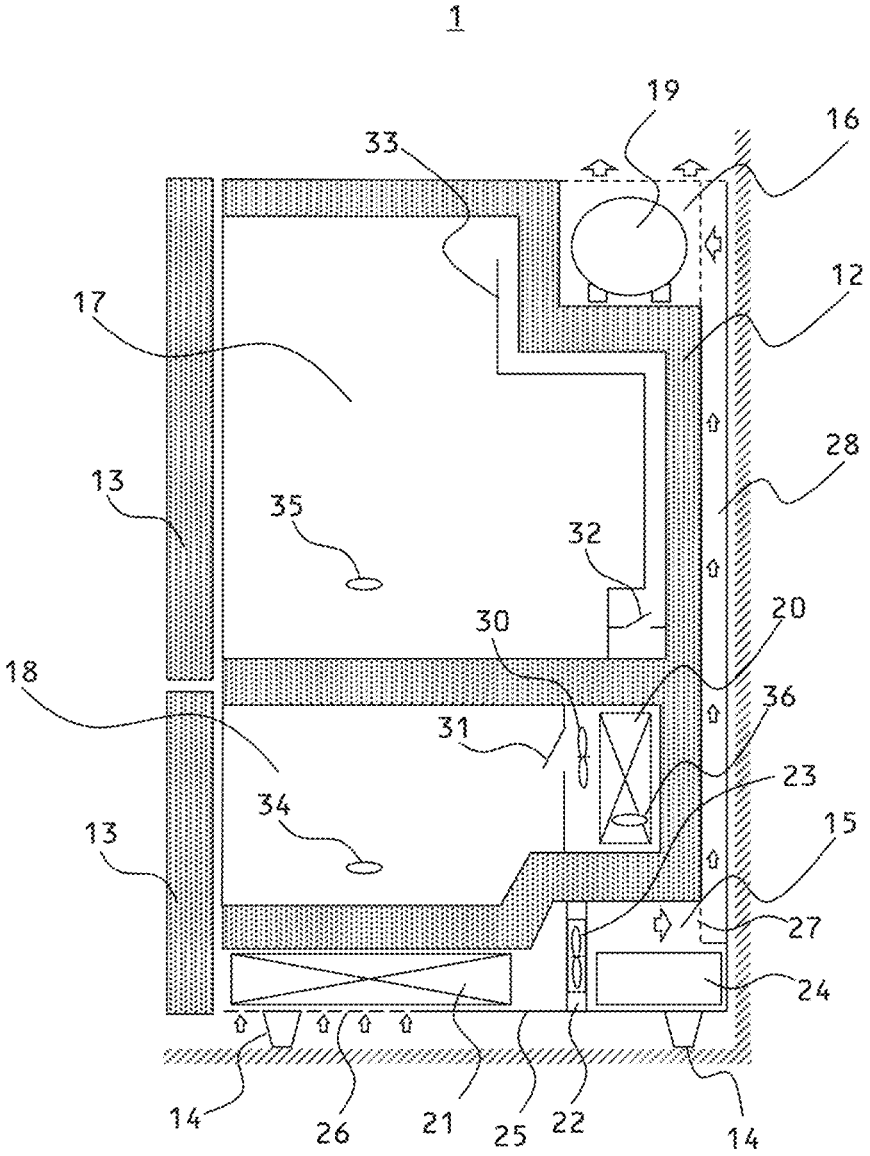
FIG. 1 is a longitudinal sectional view of a refrigerator of Embodiment 1 of the present invention.

First, an overview of the present invention is described.

The first invention includes at least a refrigeration cycle including a compressor, an evaporator, a main condenser, and a dew-prevention pipe, and includes a channel switching valve connected on the downstream side of the main condenser, a dew-prevention pipe connected on the downstream side of the channel switching valve, and a bypass connected in parallel with the dew-prevention pipe. In the first invention, when defrosting the evaporator, the channel switching valve is fully closed during the operation of the compressor to collect the refrigerant staying in the evaporator and the dew-prevention pipe, and thereafter, the compressor is stopped and the channel switching valve is opened to the bypass side to supply the collected high-pressure refrigerant to the evaporator. Then, the defrosting heater is energized after a predetermined time has elapsed.

According to the first invention, the variation in the channel resistance is suppressed when the refrigerant in the refrigeration cycle is collected in the main condenser and the refrigerant is used to heat the evaporator, whereby the electric energy of the defrosting heater can be stably reduced, and energy saving of the refrigerator can be achieved.

In the first invention, the second invention includes a channel resistance connected between the outlet of the bypass and the outlet of the dew-prevention pipe, in which, when the channel switching valve is opened to the bypass side and the high-pressure refrigerant is supplied to the evaporator so as to defrost the evaporator, the pressure in the bypass is maintained at a pressure higher than the pressure in the dew-prevention pipe.

According to the second invention, the variation in the high pressure and the channel resistance is suppressed when the refrigerant in the refrigeration cycle is collected in the main condenser and the refrigerant is used to heat the evaporator, whereby the electric energy of the defrosting heater can be stably reduced, and energy saving of the refrigerator can be achieved.

In the first or second invention, the third invention includes a heat exchanging section that thermally couples a part of the bypass path and the compressor, in which, when the channel switching valve is opened to the bypass side and the high-pressure refrigerant is supplied to the evaporator to defrost the evaporator, the waste heat of the compressor is utilized to heat the high pressure refrigerant.

According to the third invention, the waste heat of the compressor is recovered and utilized for heating the evaporator when the refrigerant in the refrigeration cycle is collected in the main condenser and the refrigerant is used to heat the evaporator, whereby the electric energy of the defrosting heater can be further reduced, and energy saving of the refrigerator can be achieved.

In the third invention, the fourth invention includes a configuration in which the channel resistance of the bypass on the upstream side of the heat exchanging section is greater than that of the bypass on the downstream side.

According to the fourth invention, when the high-pressure refrigerant is supplied to the evaporator through the bypass, the refrigerant temperature of the heat exchanging section thermally coupled with the compressor can be reduced, whereby the temperature difference from the compressor increases, and the waste heat of the compressor can be applied to a larger amount of refrigerant. Accordingly, the heating of the evaporator can be facilitated, the electric energy of the defrosting heater can be further reduced, and energy saving of the refrigerator can be achieved.

In the fourth invention, the fifth invention includes a configuration in which the bypass on the upstream side of the heat exchanging section is configured with a capillary tube.

According to the fifth invention, the heat exchange efficiency can be improved by reducing the refrigerant temperature at the heat exchanging section so as to increase the temperature difference from the compressor, burying into the heat insulating wall can be eased by reducing the diameter of the bypass on the upstream side of the heat exchanging section, and the risk of sweating due to the temperature drop of the pipe exterior wall can be reduced.

In the fourth invention, the sixth invention includes a configuration in which a throttle mechanism capable of adjusting the caliber of the channel is incorporated in a channel switching valve connected to the inlet of the bypass on the upstream side of the heat exchanging section.

According to the sixth invention, the heat exchange efficiency can be improved by reducing the refrigerant temperature at the heat exchanging section so as to increase the temperature difference from the compressor, and, with the configuration in which the throttle amount is variable, the refrigerant temperature can be adjusted to an optimum refrigerant temperature for heat exchange regardless of the variation in the outside air temperature.

The seventh invention is an operation method for a refrigerator including a compressor, an evaporator, a main condenser, and a dew-prevention pipe. The refrigerator is provided with a bypass that is provided in parallel with a first channel from the main condenser to the dew-prevention pipe so as to be connected with the evaporator. In the method, when defrosting the evaporator, the first channel and the second channel from the main condenser to the bypass are closed during an operation of the compressor to thereby collect the refrigerant staying in the evaporator, the dew-prevention pipe, and the bypass in the main condenser, and thereafter, by stopping the compressor and opening the second channel, the high-pressure refrigerant collected in the main condenser is supplied to the evaporator through the bypass.

According to the seventh invention, the variation in channel resistance is suppressed when the refrigerant in the refrigeration cycle is collected in the main condenser and the refrigerant is used to heat the evaporator, whereby the electric energy of the defrosting heater can be stably reduced, and energy saving of the refrigerator can be achieved.

Hereinabove, an overview of the present invention is described.

Figure 6:
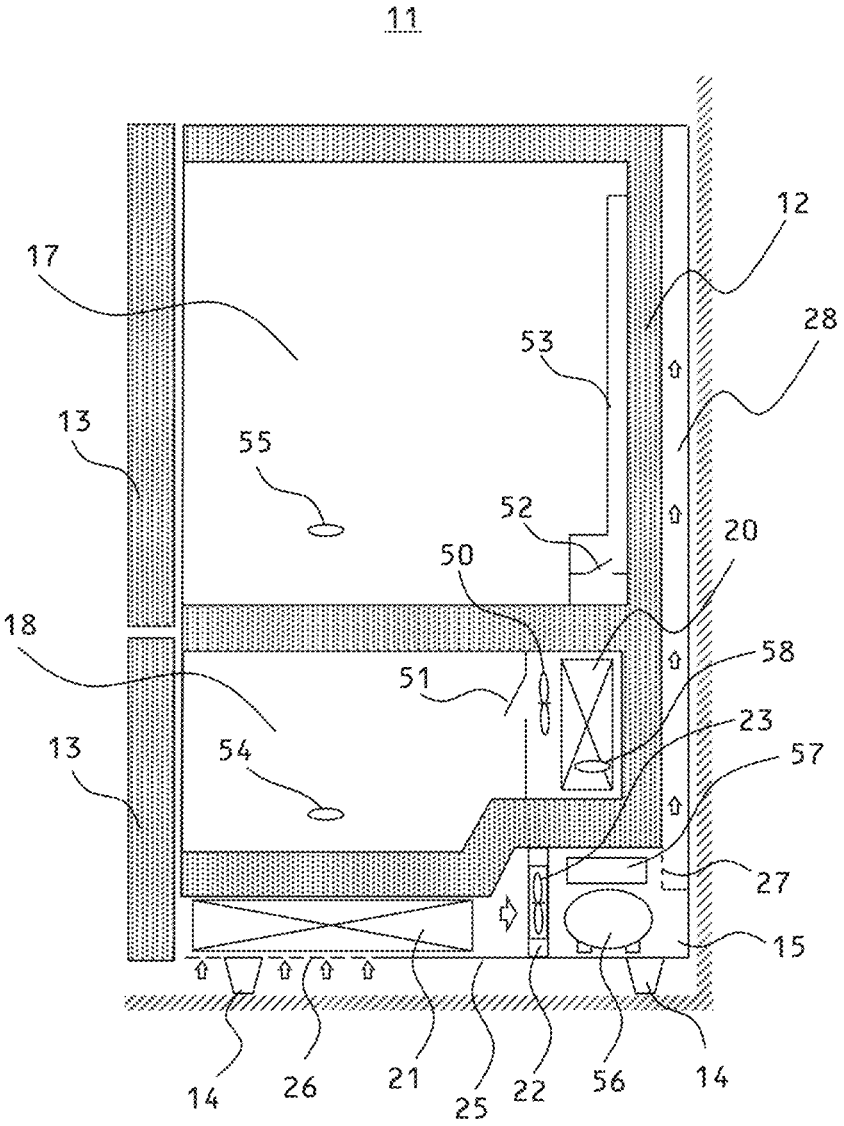
FIG. 6 is a longitudinal sectional view of a conventional refrigerator.
Figure 7:
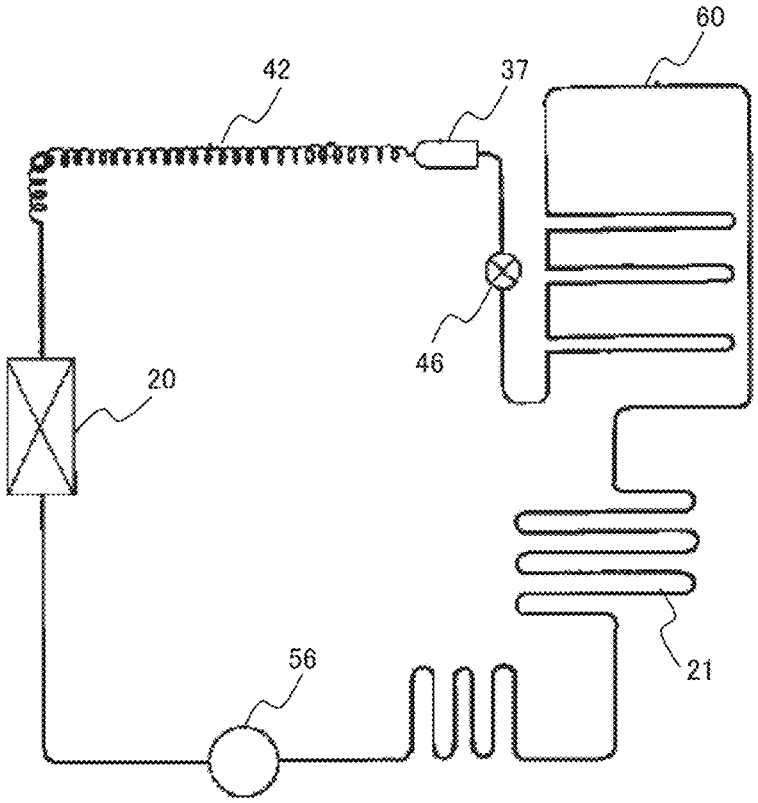
FIG. 7 illustrates a cycle configuration of a conventional refrigerator.
Figure 8:
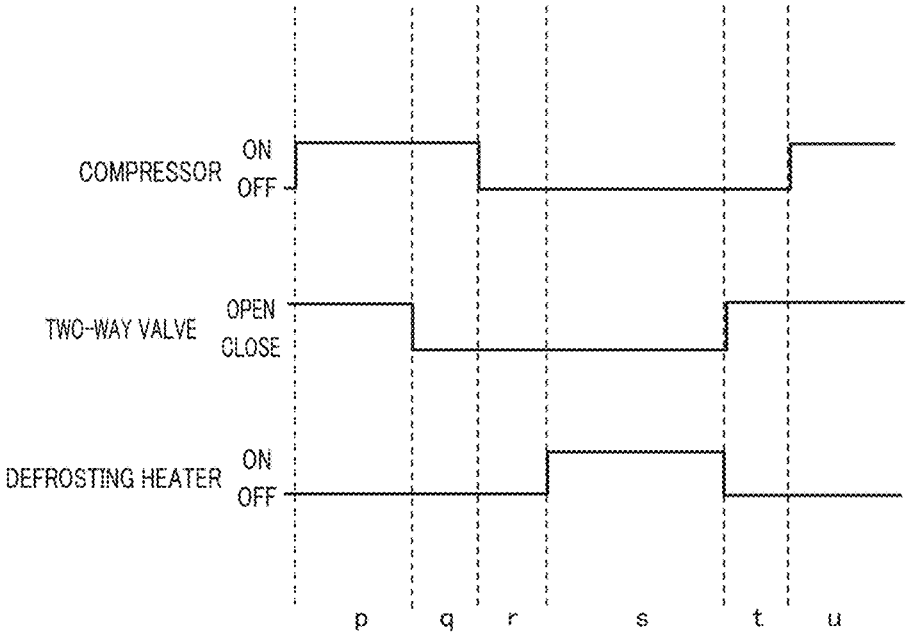
FIG. 8 illustrates an operation of a channel switching valve of a conventional refrigerator.

Embodiments of the present invention are described below with reference to the accompanying drawings. It is to be noted that, in the drawings which are used in the following description, the components identical to the components illustrated in FIG. 6 and FIG. 7 are denoted with the same reference numerals, and the description thereof is omitted. In addition, the present invention is not limited to the following embodiments.

Embodiment 1

First, a refrigerator according to Embodiment 1 of the present invention is described with reference to FIG. 1 to FIG. 3.

FIG. 1 is a longitudinal sectional view of the refrigerator of Embodiment 1. FIG. 2 illustrates a cycle configuration of the refrigerator of Embodiment 1. FIG. 3 illustrates a defrosting operation of the refrigerator of Embodiment 1.

General Configuration

As illustrated in FIG. 1, refrigerator 1 includes casing 12, door 13, leg 14 that supports casing 12, lower mechanic compartment 15 provided on the lower side of casing 12, upper mechanic compartment 16 provided on the upper side of casing 12, refrigerating compartment 17 disposed on the upper side of casing 12, and freezing compartment 18 disposed on the lower side of casing 12.

Figure 2:
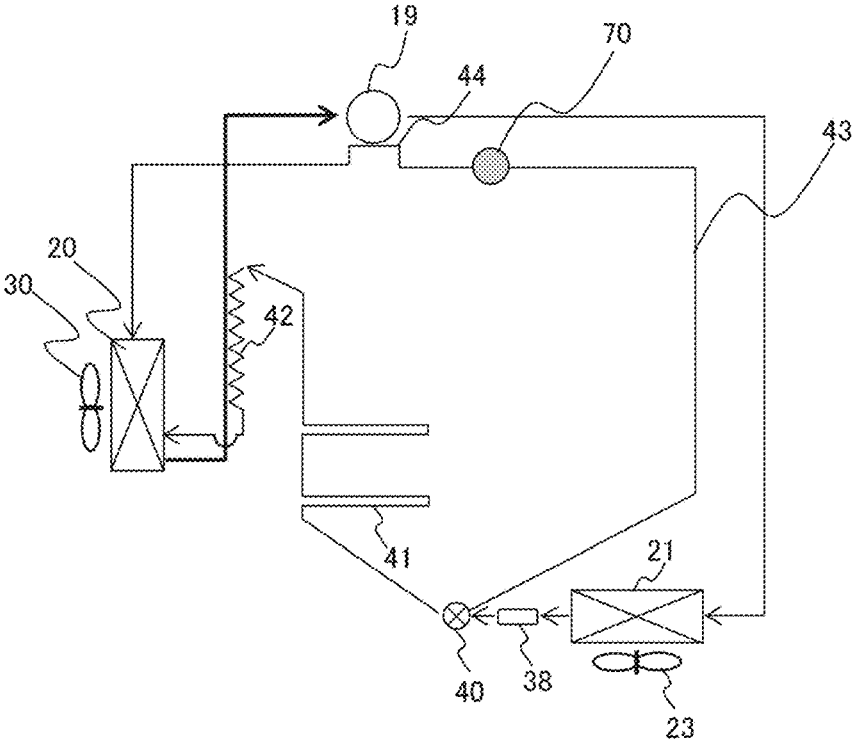
FIG. 2 illustrates a cycle configuration of the refrigerator of Embodiment 1 of the present invention.

In addition, as illustrated in FIG. 1 and FIG. 2, refrigerator 1 includes, as components of a refrigeration cycle, compressor 19 housed in upper mechanic compartment 16, evaporator 20 housed on the back side of freezing compartment 18, and main condenser 21 housed in lower mechanic compartment 15.

In addition, as illustrated in FIG. 1, refrigerator 1 includes partition wall 22 that partitions lower mechanic compartment 15, fan 23 attached on partition wall 22 and configured to air-cool main condenser 21, evaporating dish 24 installed on the air-downstream side of partition wall 22, and bottom plate 25 of lower mechanic compartment 15.

Compressor 19

Here, compressor 19 is a variable-speed compressor, and uses rotational frequencies of six levels selected from 20 to 80 rps. The reason for this is to adjust the refrigeration performance by switching the rotational frequency of compressor 19 in six levels from a low speed to a high speed, while avoiding the resonance of pipes and the like.

Compressor 19 operates at a low speed when it is activated, and the speed increases as the operation time for cooling refrigerating compartment 17 or freezing compartment 18 increases. The reason for this is to mainly use a low speed, which is most efficient, and to appropriately use a relatively high rotational frequency for increase in load of refrigerating compartment 17 or freezing compartment 18 due to a high outside air temperature, the open/close of the door and the like.

At this time, the rotational frequency of compressor 19 is controlled separately from the cooling operation mode of refrigerator 1, and the rotational frequency at the activation of a PC cooling mode (details are described later) in which the evaporation temperature is high and the refrigeration performance is relatively high may be set to a value lower than that of an FC cooling mode (details are described later). In addition, the refrigeration performance may be adjusted while reducing the speed of compressor 19 along with the temperature drop in refrigerating compartment 17 or freezing compartment 18.

Intake and Exhaust of Mechanic Compartments

As illustrated in FIG. 1, refrigerator 1 includes a plurality of intake ports 26 provided in bottom plate 25, exhaust port 27 provided on the back side of lower mechanic compartment 15, and air-communication passage 28 that connects exhaust port 27 of lower mechanic compartment 15 and upper mechanic compartment 16. Here, lower mechanic compartment 15 is divided into two compartments by partition wall 22, and houses main condenser 21 on the air-upstream side of fan 23 and evaporating dish 24 on the air-downstream side thereof.

Configuration of Refrigeration Cycle

In addition, as illustrated in FIG. 2, refrigerator 1 includes, as components of the refrigeration cycle, dryer 38, channel switching valve 40 (an example of the switching section), dew-prevention pipe 41, throttle 42, bypass 43, heat exchanging section 44, and channel resistance section 70. Dryer 38 is located on the downstream side of main condenser 21, and configured to dry the circulating refrigerant. Channel switching valve 40 is located on the downstream side of dryer 38, and configured to control the refrigerant flow. Dew-prevention pipe 41 is located on the downstream side of channel switching valve 40, and thermally coupled with the exterior surface of casing 12 in the proximity of the opening of freezing compartment 18. Throttle 42 connects dew-prevention pipe 41 and evaporator 42. Bypass 43 is provided in parallel with dew-prevention pipe 41 so as to connect the downstream side of channel switching valve 40 and evaporator 20. Heat exchanging section 44 is thermally coupled with compressor 19 in the path of bypass 43. Channel resistance section 70 is located on the upstream side of heat exchanging section 44.

Here, channel switching valve 40 can open and close a channel from main condenser 21 to dew-prevention pipe 41 (an example of the first channel) and a channel from main condenser 21 to bypass 43 (an example of the second channel). Normally, channel switching valve 40 maintains the channel from main condenser 21 to dew-prevention pipe 41 in an open state, and the channel from main condenser 21 to bypass 43 in a closed state. Channel switching valve 40 opens/closes the channels only in a defrosting operation described later.

Refrigerator Configuration and Cold Air Flow

In addition, as illustrated in FIG. 1, refrigerator 1 includes evaporator fan 30, freezing compartment damper 31, refrigerating compartment damper 32, duct 33, FCC temperature sensor 34, PCC temperature sensor 35, and DEF temperature sensor 36. Evaporator fan 30 supplies cold air generated in evaporator 20 to refrigerating compartment 17 and freezing compartment 18. Freezing compartment damper 31 blocks cold air to be supplied to freezing compartment 18. Refrigerating compartment damper 32 blocks cold air to be supplied to refrigerating compartment 17. Duct 33 supplies cold air to refrigerating compartment 17. FCC temperature sensor 34 detects the temperature of freezing compartment 18. PCC temperature sensor 35 detects the temperature of refrigerating compartment 17. DEF temperature sensor 36 detects the temperature of evaporator 20.

Here, duct 33 is formed along the wall between refrigerating compartment 17 and upper mechanic compartment 16. Duct 33 discharges, from a portion in the proximity of the center of refrigerating compartment 17, a part of cold air which passes through duct 33. In addition, duct 33 allows a large part of the cold air to pass through duct 33 in such a manner as to cool the wall surface adjacent to upper mechanic compartment 16, and discharges the large part of the cold air from the upper part of refrigerating compartment 17.

In addition, although not illustrated in the drawings, refrigerator 1 includes, for example, a the control section including a CPU (Central Processing Unit), a storage medium such as a ROM (Read Only Memory) storing a control program, a work memory such as a RAM (Random Access Memory) and the like. The control section controls these components, and executes the operations described later.

Operation

Now an operation of refrigerator 1 is described.

OFF Mode, PC Cooling Mode and FC Cooling Mode

In a cooling stop state in which fan 23, compressor 19, and evaporator fan 30 are stopped (this operation state is hereinafter referred to as "OFF mode"), when the temperature detected by FCC temperature sensor 34 is raised to FCC_ON temperature of a predetermined value, or the temperature detected by PCC temperature sensor 35 is raised to PCC_ON temperature of a predetermined value, the control section of refrigerator 1 (hereinafter referred to simply as "control section") performs a PC cooling mode. Specifically, the control section closes freezing compartment damper 31, and opens refrigerating compartment damper 32, and, drives compressor 19, fan 23, and evaporator fan 30.

In the PC cooling mode, with an operation of fan 23, main condenser 21 side of lower mechanic compartment 15 partitioned by partition wall 22 is brought into a negative pressure state and the outside air is absorbed from a plurality of intake ports 26, whereas evaporating dish 24 side of lower mechanic compartment 15 is brought into a positive pressure state and the air in lower mechanic compartment 15 is discharged to the outside from a plurality of exhaust ports 27.

On the other hand, the refrigerant discharged from compressor 19 is subjected to heat exchange with the outside air at main condenser 21 in such a manner as to be condensed while partially leaving gas, and thereafter the condensed refrigerant is subjected to moisture removal at dryer 38, and then, supplied to dew-prevention pipe 41 through channel switching valve 40. The refrigerant past dew-prevention pipe 41 heats the opening of freezing compartment 18 while being condensed with heat dissipation through casing 12, and is thereafter subjected to a pressure reduction at throttle 42. Then, the refrigerant whose pressure is thus reduced is subjected to a heat exchange with the inner air of refrigerating compartment 17 while being evaporated at evaporator 20, and flows back to compressor 19 in the form of gas refrigerant while cooling refrigerating compartment 17.

In the PC cooling mode, when the temperature detected by FCC temperature sensor 34 is raised or reduced to FCC_OFF temperature of a predetermined value and the temperature detected by PCC temperature sensor 35 is reduced to PCC_OFF temperature of a predetermined value, the control section changes the mode from the PC cooling mode to an OFF mode.

In addition, in the PC cooling mode, when the temperature detected by FCC temperature sensor 34 has a temperature higher than FCC_OFF temperature of a predetermined value and the temperature detected by PCC temperature sensor 35 is reduced to PCC_OFF temperature of a predetermined value, the control section opens freezing compartment damper 31 and closes refrigerating compartment damper 32, and, drives compressor 19, fan 23, and evaporator fan 30.

Thereafter, the control section operates the refrigeration cycle in the same manner as in the PC cooling mode to cool freezing compartment 18 by heat exchange between evaporator 20 and the inner air of freezing compartment 18 (this operation state is hereinafter referred to as "FC cooling mode").

In the FC cooling mode, when the temperature detected by FCC temperature sensor 34 is reduced to FCC_OFF temperature of a predetermined value and the temperature detected by PCC temperature sensor 35 is equal to or higher than PCC_ON temperature of a predetermined value, the control section changes the mode from the FC cooling mode to the PC cooling mode.

In addition, in the FC cooling mode, when the temperature detected by FCC temperature sensor 34 is reduced to FCC_OFF temperature of a predetermined value and the temperature detected by PCC temperature sensor 35 is lower than PCC_ON temperature of a predetermined value, the control section changes the mode from the FC cooling mode to the OFF mode.

Figure 3:
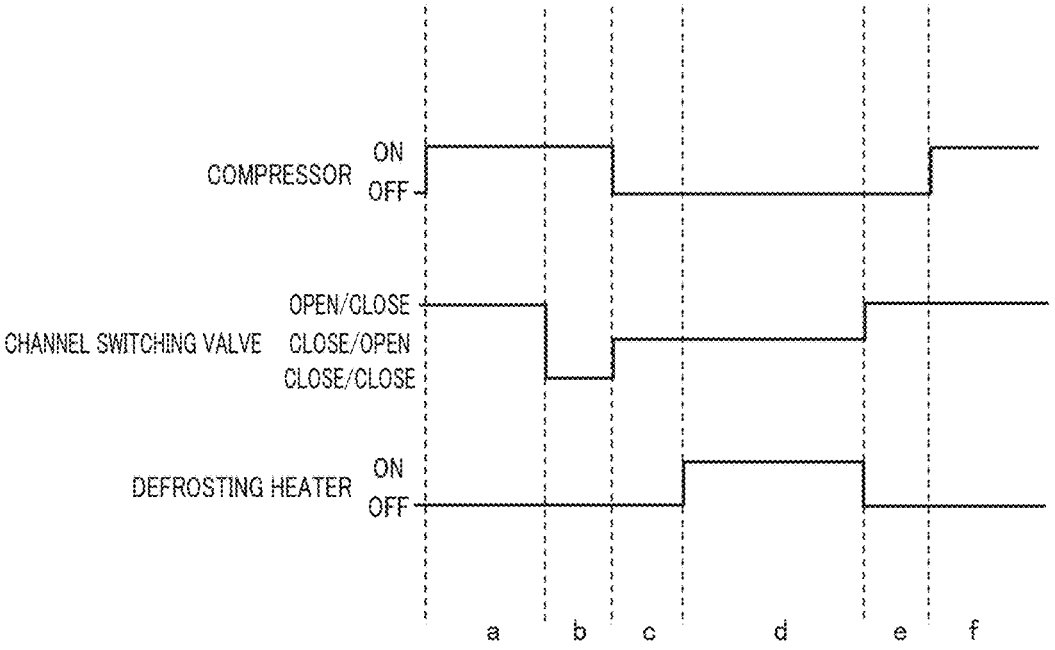
FIG. 3 illustrates a defrosting operation of the refrigerator of Embodiment 1 of the present invention.

Next, with reference to FIG. 3, a defrosting operation of refrigerator 1 of Embodiment 1 is described.

In FIG. 3, a state "open/close" of channel switching valve 40 indicates that the channel from main condenser 21 to dew-prevention pipe 41 is opened and the channel from main condenser 21 to bypass 43 is closed.

In addition, in FIG. 3, a state "close/open" of channel switching valve 40 indicates that the channel from main condenser 21 to dew-prevention pipe 41 is closed, and the channel from main condenser 21 to bypass 43 is opened.

In addition, in FIG. 3, a state "close/close" of channel switching valve 40 indicates that the channel from main condenser 21 to dew-prevention pipe 41 is closed, and the channel from main condenser 21 to bypass 43 is closed.

When the integrated operation time of compressor 19 reaches a predetermined time, the mode is changed to a defrosting mode of heating and thawing the frost of evaporator 20.

In section "a" of the defrosting mode, first, the control section cools freezing compartment 18 for a predetermined time in the same manner as in the FC cooling mode to suppress the temperature rise of freezing compartment 18.

Next, in section "b," the control section fully closes channel switching valve 40 while operating compressor 19 to close both the channel from main condenser 21 to dew-prevention pipe 41 and the channel from main condenser 21 to bypass 43, and collects, in main condenser 21, the refrigerant staying in dew-prevention pipe 41, evaporator 20, and bypass 43.

Then, in section "c," the control section stops compressor 19, and switches channel switching valve 40 to open the channel from main condenser 21 to bypass 43, thereby supplying evaporator 20 with the high-pressure refrigerant collected in main condenser 21 through bypass 43.

At this time, at heat exchanging section 44 and channel resistance section 70 provided in bypass 43, the high-pressure refrigerant is heated by the waste heat of compressor 19 in a stopped state, and thus the dryness is increased. The reason for this is that the high-pressure refrigerant dissipates heat to the outside air so as to be mostly condensed at the time of the collection into main condenser 21 in section "b." Accordingly, in comparison with the case where the high-pressure refrigerant is supplied to evaporator 20 without being heated by heat exchanging section 44 in section "c," the heat value by the condensation latent heat can be added to evaporator 20 in addition to the sensible heat of the high-pressure refrigerant maintained at the outside air temperature.

Next, in section "d," the control section energizes a defrosting heater (not illustrated; the same shall apply hereinafter) attached on evaporator 20, and terminates the defrosting. The termination of the defrosting is determined when the temperature detected by DEF temperature sensor 36 has reached a predetermined temperature.

Then, in section "e," the control section switches channel switching valve 40 such that the channel from main condenser 21 to bypass 43 is closed and the channel from main condenser 21 to dew-prevention pipe 41 is opened, so as to equalize the pressure in the refrigeration cycle, and then restarts a normal operation from section "f."

As described above, in refrigerator 1 of Embodiment 1, when, in a defrosting operation, the refrigerant staying in evaporator 20 and dew-prevention pipe 41 is collected in main condenser 21, and the high-pressure refrigerant is supplied to evaporator 20 through bypass 43, the refrigerant temperature is reduced with channel resistance section 70 on the upstream side of heat exchanging section 44. With this configuration, the temperature difference from compressor 19 increases, and the heat exchange efficiency of heat exchanging section 44 that is thermally coupled with compressor 19 is improved, whereby the waste heat of compressor 19 can be applied to a larger amount of the refrigerant to heat evaporator 20. Accordingly, refrigerator 1 can reduce the electric energy of the defrosting heater, and can achieve energy saving.

While main condenser 21 is a forced-air cooling condenser in refrigerator 1 of Embodiment 1, the present invention is not limited to this. For example, as main condenser 21, a dew-prevention pipe that is thermally coupled with the side surface and/or the back surface of casing 12 may be used. Unlike the dew-prevention pipe that is thermally coupled with a portion in the proximity of the opening of freezing compartment 18 and/or refrigerating compartment 17, the dew-prevention pipe that is thermally coupled with the side surface and/or the back surface of casing 12 can be maintained at a temperature approximately equal to the outside air temperature even when compressor 19 is in a stopped state, and a similar effect can be expected even when it is used as main condenser 21.

In addition, while channel switching valve 40 and evaporator 20 are connected by bypass 43 in refrigerator 1 of Embodiment 1, the present invention is not limited to this. For example, in the case where flow noise is generated due to an excessively high flow velocity of the high-pressure refrigerant supplied to evaporator 20 in a defrosting operation, a channel resistance for adjusting the flow may be connected in series with velocity bypass 43.

In addition, while, in refrigerator 1 of Embodiment 1, the high-pressure refrigerant is directly supplied to evaporator 20 not through dew-prevention pipe 41 or throttle 42 in a defrosting operation, thereby avoiding a situation in which the temperature of the high-pressure refrigerant is reduced under the influence of dew-prevention pipe 41 whose temperature becomes lower than that of main condenser 21 when compressor 19 is stopped, the present invention is not limited to this. When the temperature of evaporator 20 becomes higher than that of dew-prevention pipe 41 along with the defrosting, the high-pressure refrigerant might flow back from evaporator 20 to dew-prevention pipe 41 through throttle 42. Accordingly, a check valve or a two-way valve for preventing the backflow may be provided in the path from the outlet of dew-prevention pipe 41 to the inlet of evaporator 20.

In addition, in refrigerator 1 of Embodiment 1, in place of channel resistance section 70, a bypass on the upstream side of heat exchanging section 44 may be configured by use of a capillary tube. With this configuration, the refrigerant temperature at heat exchanging section 44 can be reduced, and the heat exchange efficiency can be improved by increasing the temperature difference from compressor 19. Moreover, by reducing the diameter of the bypass on the upstream side of heat exchanging section 44, burying into the heat insulating wall can be eased, and the risk of sweating due to the temperature drop of pipe exterior wall can be reduced.

In addition, in refrigerator 1 of Embodiment 1, in place of channel resistance section 70, a throttle mechanism capable of adjusting the channel caliber may be provided inside channel switching valve 40 that is connected to the inlet of the bypass on the upstream side of heat exchanging section 44. A channel switching valve provided with a throttle mechanism therein disclosed in Japanese Patent Application Laid-Open No. 2002-122366 may be applied, for example. With such a configuration, the heat exchange efficiency can be improved by increasing the temperature difference from compressor 19 by reducing the refrigerant temperature at heat exchanging section 44, and, with the variable throttle, the temperature can be adjusted to an optimum refrigerant temperature for heat exchange regardless of the variation in outside air temperature.

While the source of the heat to be applied to the refrigerant for the defrosting is the waste heat of compressor 19 in refrigerator 1 of Embodiment 1, the present invention is not limited to this. For example, by adjusting the caliber of channel resistance section 70, components other than compressor 19 such as main condenser 21 and casing 12 that fixes bypass 43 can be used as the heat source as long as the component has a temperature close to the outside air temperature.

In addition, even when compressor 19 is stopped for long periods of time and the temperature difference from the outside air temperature and/or the temperature of the refrigerant staying in condenser 20 is reduced, the temperature can be adjusted to an optimum refrigerant temperature for heat exchange by adjusting the caliber of channel resistance section 70.

Embodiment 2

While the refrigeration cycle of refrigerator 1 has the configuration illustrated in FIG. 2 in Embodiment 1, the present invention is not limited to this. In the present embodiment, the refrigeration cycle of refrigerator 1 is different from the refrigeration cycle illustrated in FIG. 2, and an example of the refrigeration cycle is described below with reference to FIG. 4 and FIG. 5. It is to be noted that the general configuration of refrigerator 1 of the present embodiment is similar to that of FIG. 1, and therefore the description thereof is omitted.

Figure 4:
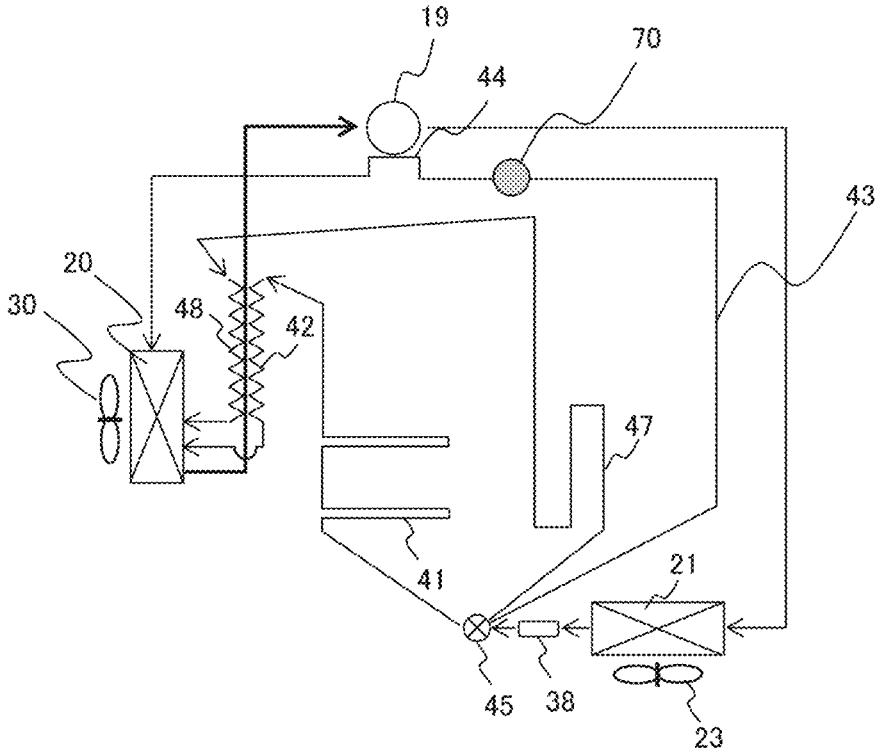
FIG. 4 illustrates a cycle configuration of a refrigerator of Embodiment 2 of the present invention.
Figure 5:
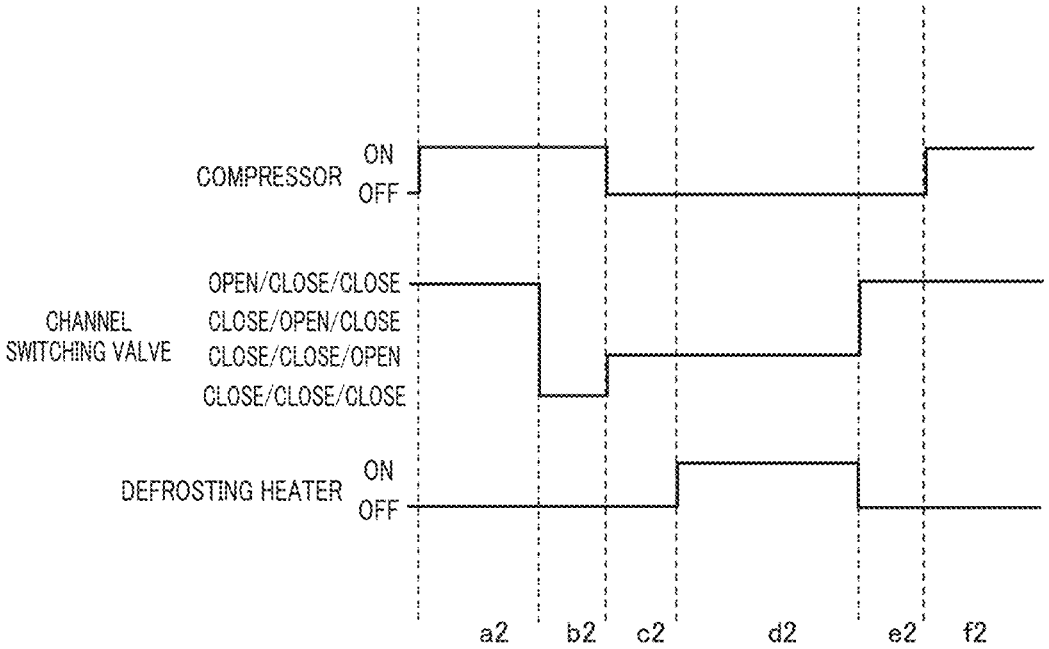
FIG. 5 illustrates a defrosting operation of the refrigerator of Embodiment 2 of the present invention.

FIG. 4 illustrates a cycle configuration of the refrigerator of Embodiment 2. FIG. 5 illustrates a defrosting operation of the refrigerator of Embodiment 2. It is to be noted that, in FIG. 4 and FIG. 5, the components identical to the components described in Embodiment 1 (the components illustrated in FIG. 1 to FIG. 3) are denoted with the same reference numerals, and the description thereof is omitted.

The configuration illustrated in FIG. 4 is different from the configuration illustrated in FIG. 2 in that channel switching valve (for example, two-way valve) 45 is provided in place of channel switching valve 40 and that second dew-prevention pipe 47 and second throttle 48 are provided.

Second dew-prevention pipe 47 and second throttle 48 are provided in parallel with dew-prevention pipe 41 and throttle 42, and in parallel with bypass 43. Then, second dew-prevention pipe 47 and second throttle 48 connect the downstream side of channel switching valve 45 and evaporator 20.

Channel switching valve 45 is located on the downstream side of dryer 38, and can open and close the channel from main condenser 21 to dew-prevention pipe 41, the channel from main condenser 21 to bypass 43, and the channel from main condenser 21 to second dew-prevention pipe 47. In the PC cooling mode, the FC cooling mode, and the OFF mode, channel switching valve 45 opens and closes the channel from main condenser 21 to dew-prevention pipe 41 or the channel from main condenser 21 to second dew-prevention pipe 47, and maintains the closed state of the channel from main condenser 21 to bypass 43. Channel switching valve 45 opens/closes the channel to bypass 43 only in the defrosting mode.

Here, second dew-prevention pipe 47 is thermally coupled with the back surface of casing 12, and is used to distribute the refrigerant while switching the path of throttle 42 and dew-prevention pipe 41, and the path of throttle 48 and second dew-prevention pipe 47 during a normal operation such as the PC cooling mode and the FC cooling mode.

Dew-prevention pipe 41 is thermally coupled with the exterior surface of casing 12 in the proximity of the opening of freezing compartment 18 where the temperature is lowest in the exterior surface of refrigerator 11. Therefore, dew-prevention pipe 41 is required to be used at all times in the case where the outside air has a high humidity, but the degree of heat intrusion into refrigerator 11 is high in comparison with second dew-prevention pipe 47, which leads to increase in heat load of refrigerator 11. In view of this, when the humidity of the outside air is low, the heat load can be suppressed by reducing the use rate of dew-prevention pipe 41 and by using second dew-prevention pipe 47 instead of dew-prevention pipe 41.

Operation

Now an operation of the above-described refrigerator 1 is described.

When the mode is the PC cooling mode and FC cooling mode, the control section divides the time into a plurality of sections of a predetermined time unit from the activation time of compressor 19, and, in accordance with the humidity of the outside air in one section, changes the use rate of dew-prevention pipe 41 and the use rate of second dew-prevention pipe 47.

For example, in the case where the outside air has a relative humidity of 50% in a certain section, the control section operates the refrigeration cycle while switching channel switching valve 45 so as to use dew-prevention pipe 41 in the earlier 60% of that section, and to use second dew-prevention pipe 47 in the remaining 40% of that section.

When the mode is the OFF mode, the control section fixes the state of channel switching valve 45 so as to open the channel of dew-prevention pipe 41 at all times.

Next, with reference to FIG. 5, a defrosting operation of refrigerator 1 of Embodiment 2 is described.

In FIG. 5, a state "open/close/close" of channel switching valve 45 indicates that the channel from main condenser 21 to dew-prevention pipe 41 is opened, and the channel from main condenser 21 to second dew-prevention pipe 41 is closed, and, the channel from main condenser 21 to bypass 43 is closed.

In addition, in FIG. 5, a state "close/open/close" of channel switching valve 45 indicates that the channel from main condenser 21 to dew-prevention pipe 41 is closed, and the channel from main condenser 21 to second dew-prevention pipe 41 is opened, and, the channel from main condenser 21 to bypass 43 is closed.

In addition, in FIG. 5, a state "close/close/open" of channel switching valve 45 indicates that the channel from main condenser 21 to dew-prevention pipe 41 is closed, and the channel from main condenser 21 to second dew-prevention pipe 41 is closed, and, the channel from main condenser 21 to bypass 43 is opened.

In addition, in FIG. 5, a state "close/close/close" of channel switching valve 45 indicates that the channel from main condenser 21 to dew-prevention pipe 41 is closed, and the channel from main condenser 21 to second dew-prevention pipe 41 is closed, and, the channel from main condenser 21 to bypass 43 is closed.

When the integrated operation time of compressor 19 reaches a predetermined time, the mode is changed to a defrosting mode of heating and thawing the frost of evaporator 20.

First, in section "a2" of the defrosting mode, the control section cools freezing compartment 18 for a predetermined time to suppress the temperature rise of freezing compartment 18 in the same manner as in the FC cooling mode.

Next, in section "b2," the control section fully closes channel switching valve 45 while operating compressor 19. In this manner, all of the channel from main condenser 21 to dew-prevention pipe 41, the channel from main condenser 21 to second dew-prevention pipe 47, and the channel from main condenser 21 to bypass 43 are closed. Then, the refrigerant staying in dew-prevention pipe 41, second dew-prevention pipe 47, bypass 43 and evaporator 20 is collected in main condenser 21.

Next, in section "c2," the control section stops compressor 19, and switches channel switching valve 45 to open the channel from main condenser 21 to bypass 43, thereby supplying evaporator 20 with the high-pressure refrigerant collected in main condenser 21 through bypass 43.

At this time, at heat exchanging section 44 and channel resistance section 70 provided in bypass 43, the high-pressure refrigerant is heated by the waste heat of compressor 19 in a stopped state, and thus the dryness is increased. The reason for this is that the high-pressure refrigerant dissipates heat to the outside air so as to be mostly condensed at the time of the collection into main condenser 21 in section "b2." Accordingly, in comparison with the case where the high-pressure refrigerant is supplied to evaporator 20 without being heated by heat exchanging section 44 in section "c2," the heat value by the condensation latent heat can be added to evaporator 20 in addition to the sensible heat of the high-pressure refrigerant maintained at the outside air temperature.

Next, in section "d2," the control section energizes a defrosting heater attached on evaporator 20, and terminates the defrosting. The termination of the defrosting is determined when the temperature detected by DEF temperature sensor 36 has reached a predetermined temperature.

Then, in section "e2," the control section switches channel switching valve 45 such that the channel from main condenser 21 to bypass 43 is closed and the channel from main condenser 21 to dew-prevention pipe 41 is opened, so as to equalize the pressure in the refrigeration cycle, and restarts the normal operation from section "f2."

As described above, refrigerator 1 of Embodiment 2 can suppress the heat load amount by switching between dew-prevention pipe 41 and second dew-prevention pipe 47 during a normal operation. In addition, in a defrosting operation, refrigerator 1 of Embodiment 2 collects, in main condenser 21, the refrigerant staying in dew-prevention pipe 41, second dew-prevention pipe 47 and evaporator 20, and heats heat evaporator 20 by supplying evaporator 20 with the high-pressure refrigerant through bypass 43 including heat exchanging section 44 that is thermally coupled with compressor 19. Accordingly, refrigerator 1 can reduce the electric energy of the defrosting heater, and can achieve energy saving of the refrigerator.

While main condenser 21 is a forced-air cooling condenser in refrigerator 1 of Embodiment 2, the present invention is not limited to this. For example, a dew-prevention pipe that is thermally coupled with the side surface and/or the back surface of casing 12 may be used as main condenser 21. Unlike the dew-prevention pipe that is thermally coupled with a portion in the proximity of the opening of freezing compartment 18 and/or refrigerating compartment 17, the dew-prevention pipe that is thermally coupled with the side surface and/or the back surface of casing 12 can be maintained at a temperature approximately equal to the outside air temperature even when compressor 19 is in a stopped state, and a similar effect can be expected even when it is used as main condenser 21.

While channel switching valve 45 and evaporator 20 are connected through bypass 43 in refrigerator 1 of Embodiment 2, the present invention is not limited to this. For example, in the case where flow noise is generated due to an excessively high flow velocity of the high-pressure refrigerant supplied to evaporator 20 in a defrosting operation, a channel resistance for adjusting the flow may be connected in series with velocity bypass 43.

In addition, while, in refrigerator 1 of Embodiment 2, the high-pressure refrigerant is directly supplied to evaporator 20 not through dew-prevention pipe 41 or throttle 42 in a defrosting operation to thereby avoid a situation in which the temperature of the high-pressure refrigerant is reduced under the influence of dew-prevention pipe 41 whose temperature becomes lower than that of main condenser 21 when compressor 19 is stopped, the present invention is not limited to this. When the temperature of evaporator 20 becomes higher than that of dew-prevention pipe 41 along with the defrosting, the high-pressure refrigerant might flow back from evaporator 20 to dew-prevention pipe 41 through throttle 42. In view of this, a check valve or a two-way valve that prevents the backflow may be provided in the path from the outlet of dew-prevention pipe 41 to the inlet of evaporator 20.

As described above, in the refrigerator according to Embodiments 1 and 2 of the present invention, in addition to the refrigerant staying in the evaporator, the refrigerant staying in the dew-prevention pipe thermally coupled with a portion in the proximity of the opening of the freezing compartment is also collected in the main condenser, and, when the collected high-pressure refrigerant is used to defrost the evaporator, the refrigerant is supplied to the evaporator through the bypass circuit. With this configuration, when the collected high-pressure refrigerant is used to defrost the evaporator, the electric energy of the defrosting heater can be stably reduced by suppressing high pressure and/or channel resistance variation.

In addition, in the refrigerator according to Embodiments 1 and 2 of the present invention, when the collected high-pressure refrigerant is used to defrost the evaporator, the refrigerant is supplied to the evaporator through the bypass circuit, and the bypass circuit and the compressor are thermally coupled to each other. With this configuration, when the high-pressure refrigerant is supplied to the evaporator, the waste heat of the compressor is recovered and utilized for heating the evaporator, whereby the electric energy of the defrosting heater can be further reduced.

The present invention is not limited to the above-mentioned embodiments, and various modifications may be made.

INDUSTRIAL APPLICABILITY

The refrigerator according to the embodiments of the present invention is applicable to a refrigerator (such as a home-use refrigerator, or a business-grade refrigerator for a supermarket and/or a place that serves food and drink) in which the refrigerant staying in the evaporator and the dew-prevention pipe is collected in the main condenser, and the energy of heating the evaporator of the high-pressure refrigerant in a refrigeration cycle flowing into the evaporator by a pressure difference is utilized to reduce the output of the defrosting electric heater.

REFERENCE SIGNS LIST

1, 11 Refrigerator
12 Casing
13 Door
14 Leg
15 Lower mechanic compartment
16 Upper mechanic compartment
17 Refrigerating compartment
18 Freezing compartment
19, 56 Compressor
20 Evaporator
21 Main condenser
22 Partition wall
23 Fan
24, 57 Evaporating dish
25 Bottom plate
26 Intake port
27 Exhaust port
28 Air-communication passage
30, 50 Evaporator fan
31, 51 Freezing compartment damper
32, 52 Refrigerating compartment damper
33, 53 Duct
34, 54 FCC temperature sensor
35, 55 PCC temperature sensor
36, 58 DEF temperature sensor
37, 38 Dryer
40, 45 Channel switching valve
41, 60 Dew-prevention pipe
42 Throttle
43 Bypass
44 Heat exchanging section
46 Two-way valve
47 Second dew-prevention pipe
48 Second throttle
70 Channel resistance section

The invention claimed is:

1. A refrigerator comprising:
a compressor;
an evaporator;
a main condenser;
a dew-prevention pipe;
a bypass provided in parallel with a first channel and connected with the evaporator, the first channel being a channel from the main condenser to the dew-prevention pipe;
a switching section provided on a downstream side of the main condenser, wherein the switching section opens and closes the first channel and a second channel, the second channel being a channel from the main condenser to the bypass; and
a control section, wherein, when defrosting the evaporator, the control section operates in such a manner that a refrigerant staying in the evaporator, the dew-prevention pipe, and the bypass is collected in the main condenser by closing the first channel and the second channel during an operation of the compressor, and thereafter, a high-pressure refrigerant collected in the main condenser is supplied to the evaporator through the bypass by stopping the compressor and opening the second channel.

2. The refrigerator according to claim 1, wherein:
the bypass includes a channel resistance section; and
when supplying the high-pressure refrigerant from the main condenser to the evaporator through the bypass, the control section maintains a pressure in the bypass at a pressure higher than a pressure in the dew-prevention pipe.

3. The refrigerator according to claim 1, wherein:
the bypass includes a heat exchanging section that is thermally coupled with the compressor; and
when supplying the high-pressure refrigerant from the main condenser to the evaporator through the bypass, the control section heats the high pressure refrigerant by utilizing a waste heat of the compressor.

4. The refrigerator according to claim 3, wherein, in the bypass, a channel resistance on an upstream side of the heat exchanging section is greater than a channel resistance on a downstream side of the heat exchanging section.

5. The refrigerator according to claim 4, wherein, in the bypass, the upstream side of the heat exchanging section is configured with a capillary tube.

6. The refrigerator according to claim 4, wherein the switching section has a throttle function capable of adjusting a caliber of the second channel.

7. An operation method of a refrigerator, the refrigerator including a compressor, an evaporator, a main condenser, and a dew-prevention pipe, wherein the refrigerator is provided with a bypass disposed in parallel with a first channel and connected with the evaporator, the first channel being a channel from the main condenser to the dew-prevention pipe, the method comprising:
when defrosting the evaporator, collecting, in the main condenser, a refrigerant staying in the evaporator, the dew-prevention pipe, and the bypass by closing the first channel and a second channel during an operation of the compressor, the second channel being a channel from the main condenser to the bypass; and
thereafter, supplying a high-pressure refrigerant collected in the main condenser to the evaporator through the bypass by stopping the compressor and opening the second channel.

* * * * *